United States Patent [19]

Väänänen

[11] Patent Number: 4,811,723

[45] Date of Patent: Mar. 14, 1989

[54] METHOD AND A DEVICE FOR THE GENERATION OF HOT AIR

[75] Inventor: Raimo Väänänen, Tampere, Finland

[73] Assignee: Partek Corporation, Helsinki, Finland

[21] Appl. No.: 10,218

[22] Filed: Feb. 3, 1987

[51] Int. Cl.[4] ..... F24H 3/14

[52] U.S. Cl. ..... 126/113; 431/190; 110/215; 110/188

[58] Field of Search ..... 126/113; 110/188, 213, 110/215; 431/4, 9, 190

[56] References Cited

U.S. PATENT DOCUMENTS

| | | | |
|---|---|---|---|
| 3,656,441 | 4/1972 | Grey et al. | 110/215 |
| 3,665,681 | 5/1972 | Vitenko | 110/215 X |
| 3,842,762 | 10/1974 | Sargent et al. | 110/215 X |
| 4,069,005 | 1/1978 | Paloni | 431/190 X |
| 4,377,067 | 3/1983 | Sternfeld et al. | 431/190 X |
| 4,493,270 | 1/1985 | Gamroth | 110/188 |
| 4,557,203 | 12/1985 | Mainord | 110/215 X |
| 4,625,661 | 12/1986 | Melchoir | 110/215 X |

*Primary Examiner*—Larry Jones

*Attorney, Agent, or Firm*—Flehr, Hohbach, Test, Albritton & Herbert

[57] ABSTRACT

The invention relates to a method and a device for the generation of hot air. According to the invention hot gases are generated in a heating space (1), and water is added to these gases so that it is evaporated and mixed with the gases. In order to provide a complete mixing and good heating properties, the hot gases are passed from the heating space (1) into a whirl chamber (2) in which the gases are brought into a whirling movement. Water is fed into the whirl chamber (2) essentially adjacent the central shaft (10) of the chamber so that the water is mechanically mixed with the hot gases when it is displaced to the periphery of the chamber by the action of the whirling movement of the gases and is evaporated by means of the heat energy contained in the hot gases. The mixture of the hot gases and the evaporated water is discharged from the whirl chamber (2) essentially at a point adjacent the central shaft (10) of the chamber at the opposite side of the chamber with rspect to the water supply point.

10 Claims, 1 Drawing Sheet

METHOD AND A DEVICE FOR THE GENERATION OF HOT AIR

Figure 1:
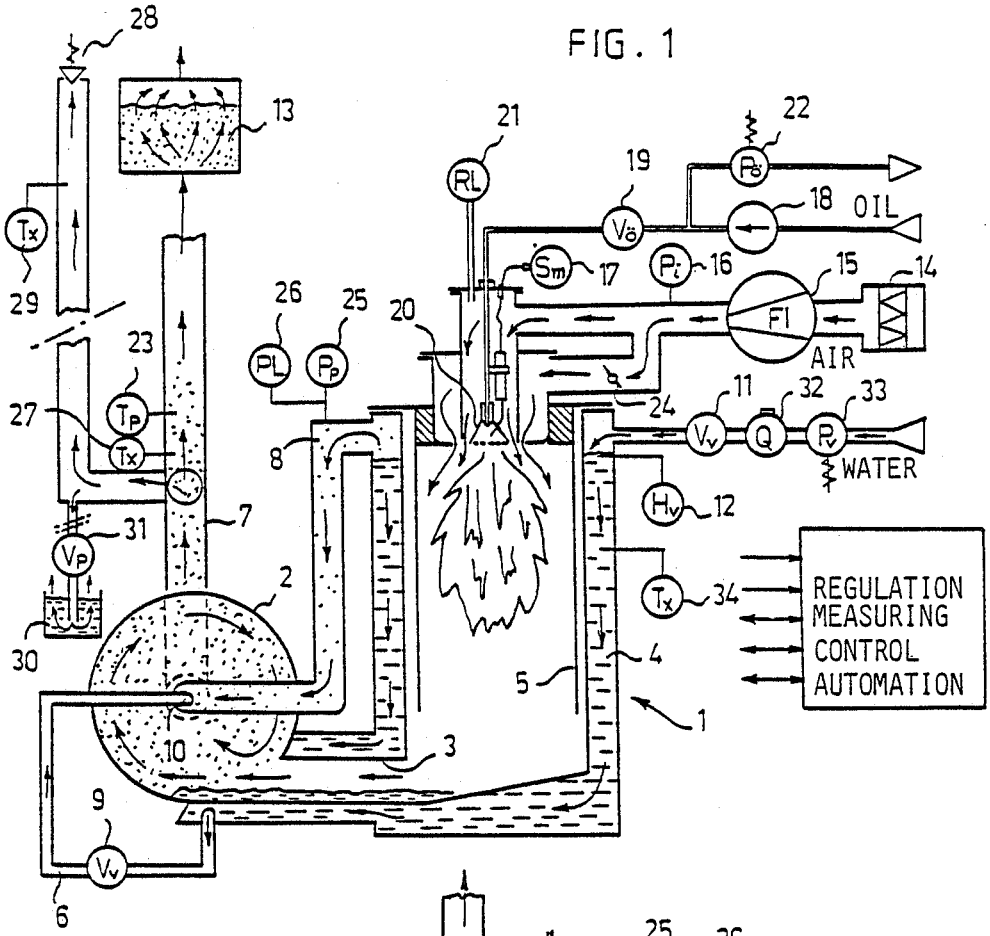

The invention relates to a method for the generation of hot air, in which method hot gases are generated in a heating space, and water is added to said gases so that it is evaporated and mixed with the gases.

So the invention is concerned with direct-acting hot-air generators from which a mixture of gas and steam is passed in one and the same pipe to the object to be heated.

In previously known direct-acting hot-air generators only so called secondary air, or in circulation air systems a mixture of flue gases returning from the process, has been mixed in the hot flue gases, while in previously known direct-acting steam generators water has been mixed with the hot flue gases in the furnace itself.

A disadvantage of known hot-air generators is that extremely large amounts of air are required for the energy transfer in a system using air as a medium. Therefore the fans, the fan engines and the heat distribution pipe systems must be very large. In addition, it is typical of the known systems that they have relatively low fan pressures, usually below 0.01 bar. On account of such low pressures gases which have been warmed up are not able to penetrate raw materials having a small grain size, such as e.g. a smooth-grained stone material the grain size of which is from 0 to 8 mm. The heating of raw materials having a small grain size requires expensive heat distribution devices which are easily clogged. Further, such materials bring about severe dust problems on account of the large quantities of air as well as great energy losses on account of the large amount of through-going air.

On the other hand, a disadvantage of known direct-acting steam generating systems is the great amount of water required in relation to the effect supplied by the system. This is due to the fact that water is not completely mixed with the flue gases but the water and the hot gas flow in one and the same pipe partially separate from each other. Consequently, steam generators of this type are used mainly for the production of hot water by means of heat-exchangers. Known systems are suitable for a direct heating of raw materials merely in processes which allow the use of large amounts of water. A further disadvantage of known systems is that the construction thereof does not allow high temperatures. Such known systems can be used with a gas drive only, since the water fed into the furnace in an oil drive leads to the cooling of the combustion space, which, in turn, results in an incomplete combustion which is harmful in many respects.

The object of the invention is to provide a method and a device for the generation of hot air, by means of which the disadvantages which have occurred in connection with previously known systems for the generation of hot air and steam have been eliminated.

This is achieved by means of the method according to the invention, which is characterized in that the hot gases are passed from the heating space into a whirl chamber and brought into a whirling movement; that water is fed into the whirl chamber essentially beside a central shaft of the chamber in such a manner that the water is mechanically mixed with the hot gases during the displacement thereof to the periphery of the chamber by the action of the whirling movement of the gases and is evaporated by means of the heat energy contained in the gases; and that the mixture of the hot gases and the evaporated water is discharged from the whirl chamber essentially beside the central shaft of the chamber at the opposite side of the chamber with respect to the water supply point.

The device according to the invention, in turn, is characterized in that the heating space is provided with a discharge pipe for hot gases; that the discharge pipe is connected to the periphery of the whirl chamber so as to bring he hot gases to a whirling movement; and that the whirl chamber is provided with water supply means which open in the chamber in the vicinity of the central shaft thereof, and with a discharge conduit for the mixture of evaporated water and hot gases, said conduit beginning from beside the central shaft at the opposite side of the chamber with respect to the inlet opening of the water supply means.

As compared with known systems the invention is advantageous in that high head capacities can be transmitted by means of small amounts of air. The air amounts are only 1/20 in comparison with known systems, for an air amount of 14,000 $m^3/h$ was used previously in a hot-air generator of 500 kW, for instance, while by means of the system according to the invention the same efficiency of 500 kW was transferred with an air amount of 690 $m^3/h$. A further advantage is that greater heat capacities can be transferred with a lower fan efficiency. Previously a fan engine efficiency of 90 kW was required for the transfer of the heat capacity of 500 kW in the example above. An efficiency of merely 15 kW is needed when the solution according to the invention is used. The saving in the fan power is thereby 75 kW. On account of the small amount of air, heat distribution pipes can be used which have considerably smaller dimensions than those of previous systems. In the example, the efficiency of 500 kW would require a fan conduit having a diameter of 500 mm. When using the solution according to the invention, the diameter required is only 100 mm. Because a mixture of hot gases and water is used in the device according to the invention, the condensation of the water mixed with the gases effects a nearly complete transfer of energy to the material to be heated, which material was sand in the example. The solution according to the invention does not, either, have any dust problems as the hot gases are moist and, besides, such dust problems are further eliminated by the small air amount. In the solution according to the invention, higher pressures can be used than in previously known systems. In the above example, enerby could be fed into a stone material having a small grain size without any expensive and inconvenient air distribution means, and the pressure could be increased five-fold as compared with a previous system by means of the invention. The pressures were 0.1 and 0.5 bar. In the above example, water was fed into a whirl chamber of the device according to the invention with an efficiency of 500 kW at a rate of about 5 1/min. Correspondingly, the amount of water required by a previously known steam generator would have been about 13 1/min with equal efficiency. The difference obtained is due to the fact that the mixture temperatures were higher in the device according to the invention, and a complete mixing and superheating of the water into the hot flue gases could be effectively carried out in the whirl chamber of the steam generator. The hot air generator according to the invention is not a steam boiler or a steam generator, since the water is not evaporated in a water-jacket, water pipe system or furnace but in a whirl chamber by a combined action of centrifugal and thermal energy. This special property allows the generator to be operated by means of any kind of energy if only hot gases are introduced in the whirl chamber. This also enables the use of direct electric heating or accumulator solutions for the heating of air. The whirl chamber system of the solution according to the invention thus also enables the use of completely dry furnace solutions. Examples of dry furnaces would be masonry furnaces and mass furnaces which are driven by oil, gas, peat, ets. An electric drive, too, is possible, as stated above. The accumulator drive means that heat energy is stored in e.g. a stone material wherefrom it is transferred to the whirl chamber with air as a medium. In the system according to the invention a water control operated by a temperature adjustment automatically provides the required amount of water so that the desired fan temperature is achieved. Accordingly, it is possible to blow mere hot air without any cooling of the water or the water-jacket, as in the case of known steam generating system, when the stored energy is exhausted. A further advantage of dry-drive furnaces is that there is no risk of freezing, provided that the supply water pipe is kept unfrozen. Still another advantage of the device according to the invention is that it is not a pressure vessel, because the water space is open or there is no such water space provided. The analyzing of the combustion of an oil or gas driven hot air generator according to the invention can be effected extremely advantageously either automatically or manually. This analysing can be carried out by passing a pressurized flue gas through pure water, whereby it can be judged from the darkening of the degree of darkening of the water whether the flame burns properly or not. The analysing vessel can be extremely advantageously positioned within the range of vision of the user of the device so that the combustion can be analysed continuously or periodically, e.g. after each ignition. As to the analysing process, it is to be mentioned here that a slight excess of air is not disadvantageous, because the heating is carried out by the real flue gases. So the analysing is mainly intended for finding out whether the combustion takes places cleanily. This can be extremely advantageously ascertained by a water analyse, because even a small amount of oil can be clearly seen as a film on the surface of the water, and soot is also easily and very quickly seen in water. In a gas drive, it is mainly a sooty combustion mostly caused by undersupply of air that can be seen by means of the water analyse. The solution according to the invention is also advantageous in that the system can be extremely advantageously provided with a safety valve. The device can be provided with a safety valve branch branching from a discharge conduit. The safety valve is thereby adjusted to a fumigation limit, i.e. to a point in which the amount of air of the combustion air fan of the burner is reduced to the minimum and this results in a combustion with undersupply of air. The safety valve can also be adjusted below the opening point of the safety valve of a rotary piston compressor, whereby a partial opening of the safety valve of the compressor does not bring about any undersupply of the combustion air. Further, a thermostat is provided to act as a leak detector for the safety valve on the blowing side, which thermostat release if the temperature rises too high in the safety valve pipe. The thermostat, however, does not release if the pressure strike is momentaneous, whereby unnecessary breaks in the operation are avoided. This safety valve arrangement makes the use of the device extremely flexible in comparison with known devices.

Figure 2:
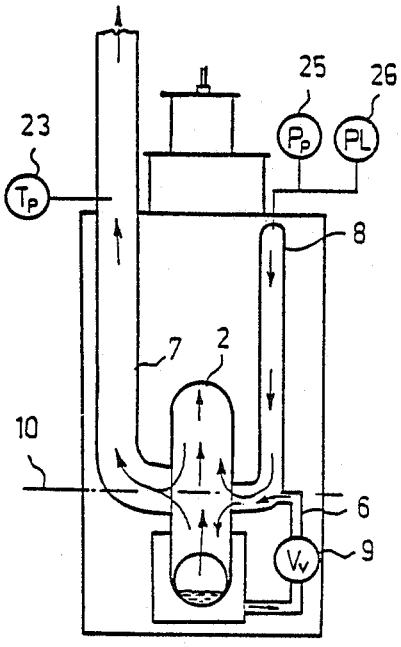

The invention will be described more closely below by means of one preferred embodiment shown in the attached drawing, whereby FIG. 1 is a general side view of one embodiment of the device according to the invention, and FIG. 2 is a general view of the device of FIG. 1 seen in another direction.

In the embodiment of the figures a heating space is indicated by the reference numeral 1. In the present embodiment the heating space 1 is a furnace. A whirl chamber is indicated by the reference numeral 2, which chamber communicates with the furnace through a discharge pipe 3. An open water space 4 is formed within the wall of the furnace to surround said furnace. The furnace is further provided with a so called dry fire tube 5 which prevents the transfer of heat through radiation from the flame of the furnace to the water. The water space 4 is connected to the whirl chamber 2 by means of a pipe connection 6, and the gases are removed from the whirl chamber through a discharge conduit 7.

An essential aspect of the invention is that the furnace does not evaporate the water contained in the water space 4, as is the case in known steam generators. The water contained in the water space 4 is thus always at a temperature below 100° C., i.e. below the evaporating point of water. An excessive warming of the water contained in the water space 4 is prevented by means of said fire tube 5, which prevents the transfer of the radiation heat of the flame to the cooling water, as mentioned above. The fire tube 5 is mounted at such a distance from the water space 4 that the maximum temperature allowed for the manufacturing material of the fire tube is not exceeded, i.e. the water contained in the water space 4 acts as a cooler for the fire tube 5. The fire tube 5 is especially advantageous in the oil drive since the fire tube rises the temperature of the combustion space to a temperature exceeding 1000° C., whereby the burning of the oil is complete. The circumstances obtained by means of the fire tube 5 mainly correspond to those of a ceramic combustion chamber. The fire tube 5 is manufactured of a thin material as the temperature of the combustion space thereby rises to the maximum value thereof in a few seconds after the ignition of the flame.

The water space 4, which is fitted within the wall of the furnace, is connected to the whirl chamber 2 above the surface of the water by means of an overflow pipe 8 having a large diameter. This arrangement provides an open structure which ensures that the water space 4 does not become a closed space under any circumstances so that the pressure in the water space does never exceed the maximum pressure of the combustion air fan.

Another important aspect of the invention is the use of the whirl chamber 2 for the mixing of the hot gases and water. In the embodiment of the figures, the hot gases are passed from the furnace into the whirl chamber through the discharge conduit 3, which is relatively narrow. One end of the discharge conduit 3 is positioned on the periphery of the whirl chamber, whereby said gases are brought into a whirling movement within the whirl chamber, as shown in the figures. The hot gases are thereby forced to the periphery of the chamber by the action of the centrifugal force. Water is fed into the whirl chamber 2 through a pipe connection and a valve 9 at the lower portion of the water space. Water is fed into the center of the whirl chamber, i.e. close to a central shaft 10 of the chamber, batchwise by a periodical or continuous adjustment of the valve 9. When the water is passed into the whirl chamber, it is thrown or it flows on the periphery of the chamber, wherein it is brought into a whirling movement with the hot gases. Being heavier than the hot gases, the water is unable to quit the whirl chamber before it has been fully evaporated and joined the hot gases. The mixture of the steam and the gas can be superheated in the whirl chamber to a temperature of up to 400° C., whereby the water amount is extremely small in relation to the heating efficiency. This is of vital importance when the condensation of water causes problems during the heating process either to the material to be heated or to the surroundings. In principle, the temperature of the mixture can be adjusted continuously within the range from 80 to 400° C. At the lowest temperatures, the device acts as a hot water generator or steam generator.

The adjustment of the amount of water can be carried out as a function of the mixture temperature by means of a water valve or batching device which is adjustable continuously in periods or continuously. When the batching device is a magnetic valve or the like, the valve 9, which feeds water into the whirl chamber, and the valve 11, which feeds water into the water space 4, are opened simultaneously. These water flows are adjusted so that they correspond to each other, i.e. the amount of water taken from the water space 4 equals to the amount added to the same space. If the amount of water fed into the whirl chamber is smaller than that fed into the water space 4, the water flows into the whirl chamber 2 through the overflow pipe 8, whereby the state of equilibrium is obtained automatically. The overflow pipe is connected to the whirl chamber at the same point as the pipe connection 6. This arrangement is advantageous in that the water contained in the water space 4 can be replaced continuously and the surface of the water in the water space is always on the right level. If the surface of the water contained in the water space 4 lowers excessively, a surface electrode opens the valve 11, whereby the surface rises to the right level. The filling of the water space 4 always takes place under the guidance of the electrode 12, if said electrode does not detect the presence of water, irrespective of whether the burner is in operation or whether the temperature adjuster requires water.

If condensated water flows into the whirl chamber 2 and the discharge conduit 3 in connection with the stopping of the device, this water is removed at the following start up in the same way as the water fed into the whirl chamber. Accordingly, the device is provided with an automatic return system for condensated water.

The afore-described water adjustment system also enables an extremely accurate adjustment of the temperature of the mixture to be blown out; with a PID adjuster, for instance, an adjusting accuracy of about 1 per cent has been obtained, i.e. the amount of water can be controlled extremely accurately.

The mixture formed in the whirl chamber is discharged from the chamber through the discharge conduit 7. The discharge conduit 7 is connected to the whirl chamber 2 beside the central shaft 10 thereof on the opposite side than the pipe connection 6 and the overflow pipe 8. This arrangement appears from FIG. 2 in particular. The mixture can be passed to any point of application by means of said conduit 7. In the embodiment of the figures, this point of application is a sand cushion 13.

The method and the device according to the invention are advantageous in that they can be controlled extremely efficiently with all amounts of water. In addition, the water is mixed with the hot gases in the whirl chamber nearly completely. As a results thereof, the amount of water required is small in relation to the efficiency. As to the thermotechnical properties thereof, the mixture is equivalent to a superheated steam at an extremely high pressure, even if the device used is a hot air generator and the pressure of the steam below 1 bar, mostly below 0.5 bar.

If the counter pressure created in the process is high and may vary, a rotary piston compressor is used as a combustion air fan, the air amount of such a compressor varying very little with the counter pressure. Within the temperature range close to 1 bar, a rotary piston compressor is always used. If the counter pressure is below 0.5 bar, high-pressure fans can be used as combustion air blowers, in which high pressure fans the amount of air is highly dependent on the counter pressure. The use of such fans, however, requires that the variation in the counter pressure is accurately known and the pressure variations occur within a narrow range only.

In principle, the device shown in FIGS. 1 and 2 operates in the following way. Combustion air is passed through a suction filter and a sound damper 14 into a rotary piston compressor 15. A pressure switch 16 ensures that the combustion air pressure is achieved and the locking for the start of the burner has been removed, whereafter the starting step can begin. The automation of the burner switches on an ignition transformer 17 so that it is in operation during the ignition process. An oil pump 18 is started and a magnetic valve 19 of the oil is opened after a time delay. When a high-pressure oil having a pressure of appr. 15 bar rushes from an oil burner orifice 20, the oil is oriented and catches fire from a high-voltage spark of the ignition transformer. A photoresitor 21 detects the flame and the fault time control of the flame detection is passed by and begins to detect the flame. The pressure of the oil is adjusted by means of a pressure adjuster 22.

After the ignition has been carried out as described above, the flame burns in the furnace within the fire tube 5. An air gap of about 10 mm is provided between the fire tube 5 and the water space. By virtue of this arrangement, the temperature of the furnace is very high, as stated above, and, further, the water contained in the water space 4 does not receive any radiation heat so that the heat transferred through conduction is not able to rise the temperature of the water to the evaporating temperature, the temperature of the water being always below 100° C. in normal use, as also stated before. The water contained in the water space 4 is made to circulate by opening the valve 9, which is positioned in the pipe connection 6 between the whirl chamber 2 and the water space 4, whereby the valve 11 opens simultaneously. As a result of the above-described arrangement, cool water is continuously received in the water space 4 and the surface of the water is maintained constant. If the water flow through the valve 11 exceeds the water flow fed through the valve 9 into the whirl chamber, any excess water flows into the whirl chamber 2 through the overflow pipe 8. The valves 9 and 11 are controlled by means of a PID temperature adjuster 23 in response to the measuring results of a temperature sensor. It is to be understood that if the level of the surface of the water contained in the water space 4 is below the electrode 12, only the valve 11 is opened, as mentioned above.

The feed of the combustion air to the burner is effected on the primary-secondary principle in such a manner that a manually adjustable flap valve 24 adjusts the amount of air. When the valve 24 is throttled, the primary air is increased and when it is opened the secondary air is increased.

The hot gases resulting from the combustion are passed into the whirl chamber 2 through the discharge pipe 3. In the whirl chamber the hot gases are brought into a whirling movement, whereby the water fed into the whirl chamber also joins the whirling movement; this water flows from the center of the chamber to the periphery thereof and remains therein until it is evaporated by the combined action of the centrifugal energy and the thermal energy. The lightened mixture of water and gas is discharged from the whirl chamber through the discharge conduit 7.

The temperature sensor 23 of the temperature adjuster, which is positioned in the discharge pipe 7, continuously measures the temperature of the mixture and adds water, if required, in accordance with the above description. The pressure switch 25 switches off the burner, if the set value of the switch is exceeded over a set period of time. The pressure data can be sent to the control unit by means of a pressure sender 26. A protection thermostat 27 for excess heat, in turn, is released if the set value thereof is exceeded. If the counter pressure of the precess exceeds the set pressure of the safety valve 28, a blast channel is opened in the atmosphere and an overpressure thermostat 29 releases the burner out of operation after a heat time delay. The overpressure thermostat 29 is also released if the safety valve 28 leaks, whereby the thermostat acts as a so called leak detector as well.

In the embodiment of the figures the gas mixture is passed from the whirl chamber 2 to the material to be heated, e.g. a sand cushion 13 which it penetrates so that the water contained in the mixture is condensated in the sand cushion, thus efficiently releasing its heat energy. At the same time the moisture prevents the sand cushion from getting dry and dusty. The water produced in the burning process is also condensated in the sand cushion, whereby the burning efficiency may amount up to 100 per cent and more, calculated on the given specific heat capacity of the oil. Naturally, this requires that the flue gases are cooled below the dew point of the flue gases. This kind cooling is achieved e.g. when a frozen sand is melted.

The analysing of the combustion can be carried out automatically by means of a transparent vessel 30. The hot gases are thereby automatically passed through the water contained in the vessel at determined intervals by means of a valve 31 so that an incomplete combustion can be immediately seen as a color change in the pure water. The number of the vessels can, of course, be chosen as required.

The amount of the water fed into the water space 4 as well as the pressure can be measured and adjusted by suitable means 32, 33. The temperature of the water space 4 is observed by means of a limiter 34. The limiter 34 is adjusted to 93° C. and after this temperatures has been exceeded, the limiter stops the burner.

The above-described embodiment is not intended to restrict the invention in any way, but the invention can be modified within the claims in various ways. So it is evident that the heating space 1 does not need to be a furnace but some other structure can be used as well, e.g. an electrically operated device. The heating space can also be replaced by some other process, the hot discharge gases of which are passed into the whirl chamber. The feed of water into the whirl chamber can thereby be arranged from a suitable container or the like.

I claim:

1. In a method of generating hot air by generating hot gases in a heating space and adding water to said hot gases such that said added water is evaporated and mixed with said hot gases, the improvement wherein said hot gases are passed from said heating space into a whirl chamber having a horizontal central axis and a periphery zone therein and brought into a whirling motion around said horizontal central axis inside said whirl chamber, wherein said water is fed into said whirl chamber at an inlet position proximal to said horizontal central axis such that said water becomes mixed with said hot gases while said hot gases are displaced to said peripheral zone by said whirling motion of said gases and is evaporated by heat energy of said hot gases, and wherein said mixture of water and hot gases is discharged from said whirl chamber through an outlet position proximal to said horizontal central axis and opposite from said inlet position.

2. The method of claim 1 wherein said heating space comprises a furnace.

3. The method of claim 2 wherein said hot gases include flue gases of said furnace.

4. The method of claim 2 wherein said cooling water used for cooling said furnace is fed into said whirl chamber.

5. A device for generating hot air comprising a heating space for generating hot gases therein, a whirl chamber having a horizontal central axis, a peripheral zone, a water inlet which opens into said whirl chamber near said horizontal central axis for supplying water into said whirl chamber and an outlet opening for a discharge conduit for discharging a mixture of evaporated water and hot gases therethrough from said whirl chamber, said outlet opening and said water inlet being opposite from each other with respect to said whirl chamber, and a connecting pipe connected to said heating space and to said peripheral zone of said whirl chamber for bringing hot gases from said heating space into a whirling motion around said horizontal central axis inside said whirl chamber.

6. The device of claim 5 further comprising water supply means for supplying water into said whirl chamber through said water inlet.

7. The device of claim 5 wherein said heating space comprises a furnace, flue gases for said furnace being used as hot gases in said whirl chamber.

8. The device of claim 7 further comprising an open water space between an outer wall of said furnace and a first tube such that cooling water in said open water space serves to cool said furnace and that said first tube serves to protect said cooling water against radiation heat from said furnace.

9. The device of claim 8 wherein said open water space is connected to said whirl chamber near said horizontal central axis such that said cooling water is supplied into said whirl chamber.

10. The device of claim 8 wherein said open water space is at an upper part of said device and connected to said whirl chamber near said horizontal central axis through an overflow pipe for said open water space, said overflow pipe serving to supply said cooling water into said whirl chamber.

* * * * *